US011421166B2

(12) United States Patent
Weiss et al.

(10) Patent No.: US 11,421,166 B2
(45) Date of Patent: Aug. 23, 2022

(54) PROCESS FOR THE PRODUCTION OF FUELS OF HEAVY FUEL TYPE FROM A HEAVY HYDROCARBON-CONTAINING FEEDSTOCK USING A SEPARATION BETWEEN THE HYDROTREATMENT STAGE AND THE HYDROCRACKING STAGE

(71) Applicant: IFP ENERGIES NOUVELLES, Rueil-Malmaison (FR)

(72) Inventors: Wilfried Weiss, Valencin (FR); Isabelle Merdrignac, Chaponnay (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 505 days.

(21) Appl. No.: 14/932,379

(22) Filed: Nov. 4, 2015

(65) Prior Publication Data

US 2016/0122666 A1 May 5, 2016

(30) Foreign Application Priority Data

Nov. 4, 2014 (FR) ..... 1460629

(51) Int. Cl.
*C10G 67/02* (2006.01)
*C10G 49/00* (2006.01)
(Continued)

(52) U.S. Cl.
CPC ..... *C10G 67/02* (2013.01); *C10G 49/002* (2013.01); *C10G 65/12* (2013.01); *C10L 1/08* (2013.01); *C10G 2300/107* (2013.01); *C10G 2300/1077* (2013.01); *C10G 2300/202* (2013.01); *C10G 2300/206* (2013.01); *C10G 2300/208* (2013.01); *C10L 2200/0415* (2013.01); *C10L 2200/0446* (2013.01); *C10L 2270/026* (2013.01)

(58) Field of Classification Search
CPC ..... C10G 65/02; C10G 65/12; C10G 67/00; C10G 47/00–20; C10G 47/36
See application file for complete search history.

(56) References Cited

U.S. PATENT DOCUMENTS 4,676,886 A * 6/1987 Rahbe ..... C10B 55/00 208/131
4,732,664 A * 3/1988 Solari Martini ..... C10G 21/003 208/112
(Continued)

FOREIGN PATENT DOCUMENTS

WO 2014096704 A1 6/2014

OTHER PUBLICATIONS

Search Report dated Jul. 13, 2015 issued in corresponding application FR 1460629 (pp. 1-2).

*Primary Examiner* — Michelle Stein
(74) *Attorney, Agent, or Firm* — Millen, White, Zelano & Branigan, PC; Ryan Pool

(57) ABSTRACT

The present invention describes a process for the production of fuel of the heavy fuel oil type, this fuel optionally being able to become a marine fuel, from a heavy hydrocarbon-containing feedstock having a sulphur content of at least 0.5% by weight, an initial boiling temperature of at least 350° C. and a final boiling temperature of at least 450° C., a process using a fixed-bed hydrotreatment stage, an intermediate separation and a hydrocracking stage comprising at least one reactor of the hybrid type.

21 Claims, 2 Drawing Sheets

(51) Int. Cl.
*C10G 65/12* (2006.01)
*C10L 1/08* (2006.01)

(56) References Cited

U.S. PATENT DOCUMENTS

| | | | | |
|---|---|---|---|---|
| 5,417,846 | A * | 5/1995 | Renard | C10G 65/04 208/210 |
| 5,968,346 | A * | 10/1999 | Jung | C10G 65/04 208/210 |
| 7,815,870 | B2 | 10/2010 | Lott et al. | |
| 9,834,731 | B2 * | 12/2017 | Weiss | C10G 67/02 |
| 9,840,674 | B2 * | 12/2017 | Weiss | C10G 31/06 |
| 2006/0196809 | A1 * | 9/2006 | Mukherjee | C10G 65/12 208/57 |
| 2008/0193345 | A1 * | 8/2008 | Lott | B01J 8/226 422/187 |
| 2010/0065473 | A1 * | 3/2010 | Chabot | C10G 65/12 208/57 |
| 2011/0005976 | A1 * | 1/2011 | Rispoli | C10G 1/06 208/390 |
| 2011/0230688 | A1 * | 9/2011 | Charon | C10G 1/002 585/240 |

* cited by examiner

PROCESS FOR THE PRODUCTION OF FUELS OF HEAVY FUEL TYPE FROM A HEAVY HYDROCARBON-CONTAINING FEEDSTOCK USING A SEPARATION BETWEEN THE HYDROTREATMENT STAGE AND THE HYDROCRACKING STAGE

FIELD OF THE INVENTION

The present invention relates to the refining and conversion of heavy hydrocarbon fractions containing, among other things, sulphur-containing impurities. It relates more particularly to a process for the treatment of heavy petroleum feedstocks for the production of fuel oils and fuel-oil bases, in particular of bunker oils and bunker oil bases, with a low sulphur content and with a low sediment content.

EXAMINATION OF THE PRIOR ART

The objective of the present invention is to produce fuel oils and fuel-oil bases, in particular bunker oils and bunker oil bases in accordance with the recommendations of the MARPOL convention in terms of equivalent sulphur content, and preferably also in accordance with the recommendations on the sediment content after ageing, as described for marine fuels in the standard ISO 8217.

The fuel oils used in maritime transport generally comprise atmospheric distillates, vacuum distillates, atmospheric residues and vacuum residues originating from direct distillation or originating from refining processes, in particular hydrotreatment and conversion processes, these cuts being able to be used alone or in a mixture.

Another objective of the present invention is to produce jointly, by means of the same process, atmospheric distillates (naphtha, kerosene, diesel), vacuum distillates and/or light gases (C1 to C4). The naphtha- and diesel-type bases can be upcycled in the refinery for the production of automobile and aviation fuels, such as for example premium-grade gasolines, jet fuels and gas oils.

Among the relevant documents of the prior art the following may be mentioned:

- U.S. Pat. No. 7,815,870 which describes a hydrocracking process with at least one ebullating bed operating with a supported catalyst and a dispersed catalyst (hybrid mode). In this document there may additionally be one or more reactors of the fixed bed or "slurry" type upstream or downstream, but in all cases, the ebullating bed operates in hybrid mode, however the cited document does not describe the conditions of a sequence with a prior hydrotreatment stage allowing the hydrodesulphurization and conversion performances as presented in the present application. The cited document also does not describe the post-treatment allowing the reduction in the sediment content so as to satisfy the quality requirements for bunker oils.
- U.S. Pat. No. 5,358,629/U.S. Pat. No. 5,622,616/U.S. Pat. No. 5,868,923 which describe the injection of dispersed catalyst into an ebullating bed. The processes described in these texts do not describe upstream hydrotreatment.

Therefore, none of these documents describes the production of a fuel oil or fuel-oil bases with a very low sulphur content corresponding to the new recommendations of the International Maritime Organization, and with a low sediment content as required by the new version of the standard ISO 8217:2012.

The present invention makes it possible to improve the conversion processes described in the state of the art for the production of fuel oils and fuel-oil bases with a low sulphur content.

It is based on the following sequence of stages:

- a hydrotreatment stage in which at least one of the reactors operates as a fixed bed,
- a stage of separation of the effluents from the hydrotreatment stage making it possible to release a heavy cut,
- a stage of hydrocracking said heavy cut using reactors at least one of which is of the hybrid type.
- a stage of separation of the effluent from the hydrocracking stage making it possible to release a heavy cut,
- an optional stage of treatment of the sediments from said heavy cut,
- an optional stage of separation of the effluent from the sediment treatment stage.

BRIEF DESCRIPTION OF THE INVENTION

Figure 1:
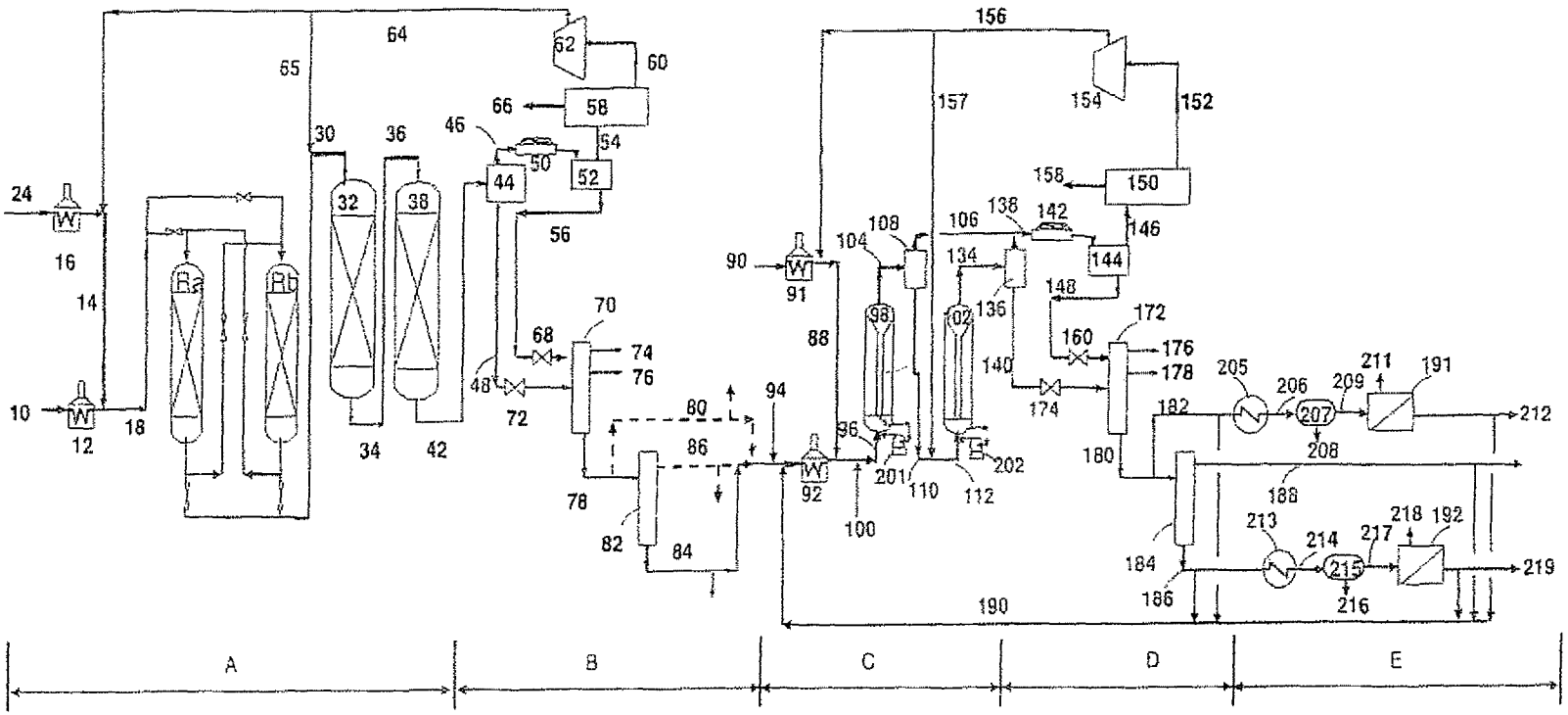
FIG. 1 shows a diagrammatic view of the process according to the invention, showing a hydrotreatment zone, a zone of separation of the effluent from the hydrotreatment zone, a hydrocracking zone and a zone of separation of the effluent from the hydrocracking zone and a zone of treatment/separation of the sediments contained in the heavy cut originating from the zone of separation of the hydrocracking effluent.

The present invention can be defined as a process for the treatment of a heavy hydrocarbon-containing feedstock having a sulphur content of at least 0.5% by weight, an initial boiling temperature of at least 350° C., and a final boiling temperature of at least 450° C., making it possible to obtain at least one liquid hydrocarbon-containing fraction having a sulphur content less than or equal to 0.5% by weight, a process comprising the following successive stages:

a) a fixed-bed hydrotreatment stage, in which the hydrocarbon-containing feedstock and hydrogen are brought into contact on a hydrotreatment catalyst, b) a stage of separation of the effluent obtained at the end of hydrotreatment stage (a) into at least one light fraction and at least one heavy fraction, c) a stage of hydrocracking of at least a part of the heavy fraction of the effluent originating from stage (b), alone or in a mixture with other residual or fluxing cuts, in at least one reactor operating in hybrid mode, i.e. operating in an ebullating bed with a supported catalyst combined with a "dispersed" catalyst constituted by very fine particles of catalyst constituting a suspension with the hydrocarbon-containing liquid phase to be treated, d) a stage of separation of the effluent originating from stage (c) in order to obtain at least one light fraction and at least one heavy fraction, said heavy fraction constituting the liquid hydrocarbon-containing fraction mentioned in the preamble, e) a stage of treatment of the heavy fraction originating from stage d) making it possible to reduce the sediment content of said heavy fraction, f) a final stage of separation of the effluent originating from treatment stage e) in order to obtain said liquid hydrocarbon-containing fraction with a reduced sediment content.

An ebullating bed can be defined as a solid liquid gas fluidized bed in which the particles of catalyst have a size comprised between 0.5 and 1.5 mm, preferentially comprised between 0.8 mm and 1.2 mm, and even more preferably comprised between 0.9 mm and 1.1 mm.

A hybrid-type bed corresponds to an ebullating bed into which an additional injection of a dispersed catalyst is carried out.

A dispersed catalyst is a catalyst in the form of very fine particles, i.e. generally a size comprised between 1 nanometre (i.e. 10 m) and 150 micrometres, preferably between 0.1 and 100 micrometres, and even more preferably, between 10 and 80 microns.

A hybrid bed therefore comprises two populations of catalyst, a population of catalyst of the ebullating bed type to which a population of catalyst of the dispersed type is added.

The HCAT® technology marketed by the company HTI is an example of the utilization of dispersed catalyst injected into an ebullating-bed reactor.

The process for the treatment of a heavy hydrocarbon-containing feedstock according to the present invention can be available in several variants.

In a first variant, the hydrocracking stage c) comprises a first reactor of the ebullating bed type followed by a second reactor of the "hybrid" bed type, (i.e. of the ebullating bed type with injection of catalyst of the "dispersed" type).

In a second variant, the hydrocracking stage c) comprises a first reactor of the hybrid bed type followed by a second reactor of the hybrid type.

In a third variant, the hydrocracking stage c) comprises a single reactor of the hybrid bed type.

The process for the treatment of a heavy hydrocarbon-containing feedstock according to the present invention comprises a stage a) of hydrotreatment in a fixed bed operated under the following conditions:

- a temperature comprised between 300° C. and 500° C., preferably between 350° C. and 420° C., an absolute pressure comprised between 2 MPa and 35 MPa, preferably between 11 MPa and 20 MPa,
- a space velocity of the hydrocarbon-containing feedstock, commonly called LHSV, which is defined as being the volume flow rate of feedstock taken under the process conditions divided by the total volume of the reactor, comprised within a range from 0.1 h−1 to 5 h−1, preferentially from 0.1 h−1 to 2 h−1, and more preferentially from 0.1 h−1 to 0.45 h−1,
- a quantity of hydrogen mixed with the feedstock comprised between 100 and 5000 normal cubic metres (Nm3) per cubic metre (m3) of liquid feedstock, preferentially between 200 Nm3/m3 and 2000 Nm3/m3, and more preferentially between 300 Nm3/m3 and 1500 Nm3/m3.

The process according to the present invention also uses a hydrocracking stage c) treating at least one heavy fraction originating from the separation of the effluent from the hydrotreatment stage. This hydrocracking stage comprises at least one reactor of the hybrid type, this reactor generally operating under the following conditions:

- a partial pressure of hydrogen varying from 2 to 35 MPa, and preferentially from 10 to 25 MPa,
- a temperature comprised between 330° C. and 550° C., preferably from 350° C. to 500° C., even more preferentially between 370° C. and 480° C.,
- an hourly space velocity (reactor LHSV, i.e. the ratio between the volume flow rate of feedstock and the reactor volume) comprised between 0.1 and 10 h−1, preferably from 0.1 h to 5 h−1 and more preferably between 0.1 and 2 h−1,
- an "ebullating-bed catalyst" hourly space velocity for the ebullating-bed or hybrid reactors comprised between 0.1 and 5 h−1, preferably from 0.1 h to 3 h−1 and more preferably between 0.1 and 1 h−1, the "ebullating-bed catalyst" LHSV being defined as the ratio between the volume flow rate of feedstock in m3/h and the volume in m3 of inactive ebullating-bed catalyst, i.e. when the expansion rate of the ebullating bed is zero,
- a content of metal compounds in the catalysts used in the hybrid bed comprised between 0 and 10% by weight, preferably between 0 and 1% by weight, said content being expressed as a percentage by weight of metallic elements of group VIII and/or of group VIB,
- a hydrogen/feedstock ratio comprised between 50 and 5000 Nm3/m3, preferentially comprised between 100 and 1500 Nm3/m3 with an even more preferred range between 500 and 1300 Nm3/m3.

In a variant of the process for the treatment of a heavy hydrocarbon-containing feedstock according to the invention, said liquid hydrocarbon-containing fraction originating from the separation stage d) also undergoes a treatment stage e) making it possible to treat and separate sediments and residues from catalysts, by means of a maturation converting the potential sediments to existing sediments then a physical separation allowing the removal of all of the existing sediments.

In another variant of the process for the treatment of a heavy hydrocarbon-containing feedstock according to the present invention, said liquid hydrocarbon-containing fraction also undergoes a stage of recovery of the "dispersed" catalyst in addition to the treatment stage e) making it possible to treat and separate sediments and residues from catalysts.

Stage d) of separation of the effluent originating from the hydrocracking stage can be carried out either in a summary manner, making it possible to obtain one or two liquid fractions, or in a more complete manner, then making it possible to obtain at least three liquid fractions.

The separation d) carried out in a more complete manner thus makes it possible to obtain atmospheric and/or vacuum distillate cuts (naphtha, kerosene, gas oil, vacuum gas oil for example) completely separated from the atmospheric and/or vacuum residue.

The manner in which this separation stage is carried out determines the sequence of the optional stages e) and f).

The treatment stage e) makes it possible to convert, by maturation, the potential sediments contained in the heavy fraction originating from the upstream separation d), to existing sediments, then to separate them from the liquid fraction. This treatment stage therefore comprises a physical separation of the sediments formed. So as not to create confusion with respect to the upstream d) and downstream f) separations, we have not given a specific name to this separation which thus forms an integral part of the treatment stage e).

The final optional separation stage f) is necessary in the case where the upstream separation d) has been carried out in a summary manner. The final separation stage f) then makes it possible to separate the heavy hydrocarbon-containing fraction with a reduced sediment content which can then constitute a marine fuel within the meaning of the standard ISO 8217.

DETAILED DESCRIPTION OF THE INVENTION

Throughout the description, the expression which follows the expression "comprised between . . . and . . . " must be understood as including the limits mentioned.

The process according to the invention therefore comprises:

- a fixed-bed hydrotreatment stage (a), then
- a stage (b) of separation of the hydrotreated effluent into at least one light fraction and at least one heavy fraction,
- a stage (c) of hydrocracking at least a part of the heavy fraction originating from stage (b), alone or in a mixture with other residual or fluxing cuts, in at least one reactor operating in hybrid mode, i.e. operating in an ebullating bed with a supported catalyst combined with a "dispersed" catalyst constituted by very fine particles of catalyst constituting a suspension with the hydrocarbon-containing liquid phase to be treated,
- a stage (d) of separation of the effluent from the hydrocracking zone c) making it possible to obtain at least one light fraction and at least one heavy fraction,
- e) an optional sediment treatment stage making it possible to reduce the sediment content of the heavy fraction and to obtain said liquid hydrocarbon-containing fraction with a reduced sediment content (less than 0.1% by weight).
- f) an optional stage of final separation of the effluent originating from the treatment stage e) in order to obtain distillates and said liquid hydrocarbon-containing fraction with a reduced sediment content.

The scope of the present invention is defined by the fact that one of the reactors of the hydrocracking zone is of the hybrid type, the other reactors of the hydrocracking zone being able to be of an ebullating, or "hybrid" type. For the sake of simplicity in the remainder of the text reference will be made to a hydrocracking zone in "hybrid" mode or bed.

The objective of the fixed-bed hydrotreatment stage a) is both to refine, i.e. to substantially reduce the content of metals, sulphur and other impurities, and to improve the hydrogen-to-carbon (H/C) ratio of the hydrocarbon-containing feedstock while converting said hydrocarbon-containing feedstock at least partially to lighter cuts.

The effluent obtained at the end of fixed-bed hydrotreatment stage (a) is then subjected to a separation stage b) making it possible to obtain different fractions. This separation makes it possible to remove from the effluent obtained at the end of hydrotreatment stage (a), the lightest fractions which require no additional treatment, or a moderate treatment, and to recover a heavy fraction which is sent to the hybrid-bed hydrocracking stage (c) which makes it possible to partially convert said heavy fraction in order to produce an effluent which can be wholly or partially used as fuel oil or as fuel-oil base, in particular as bunker oil or as bunker oil base.

One of the benefits of the sequence of a fixed-bed hydrotreatment, then "hybrid" bed hydrocracking resides in the fact that the feedstock of the hybrid-bed hydrocracking reactor is already at least partially hydrotreated.

In this way, it is possible to obtain, with equivalent conversion, hydrocarbon-containing effluents of better quality, in particular with lower sulphur contents.

Furthermore, the consumption of catalysts, supported and dispersed, in the hybrid-bed hydrocracking stage is greatly reduced compared to a process without prior fixed-bed hydrotreatment.

The intermediate separation stage b) between the hydrotreatment stage a) and the hydrocracking stage c) advantageously makes it possible to minimize the fraction to be treated in said hydrocracking stage c). In this way, the capacity of the hybrid-bed hydrocracking reaction section can be less significant. Similarly, the over-cracking of the light fractions and therefore a loss of yield in fuel-type fractions are avoided.

The separation stage b) also makes it possible to remove a part of the hydrogen introduced upstream of the hydrotreatment stage a), which makes it possible to work with different hydrogen coverage rates in the hydrotreatment stage a) and the hydrocracking stage c). The removal, during the separation stage b), of light fractions, and in particular of a large part of the hydrogen sulphide formed during the hydrotreatment stage a), makes it possible to work at a higher partial pressure of hydrogen (for the same total pressure) during the hydrocracking stage, thus leading to products of better quality.

The Hydrocarbon-Containing Feedstock

The hydrocarbon-containing feedstock treated in the process according to the invention can be described as heavy feedstock. It has an initial boiling temperature of at least 350° C. and a final boiling temperature of at least 450° C. Preferably, its initial boiling temperature is at least 375° C., and its final boiling temperature is at least 460° C., preferentially at least 500° C., and even more preferentially at least 600° C.

The hydrocarbon-containing feedstock can be selected from the atmospheric residues (AR) originating from an atmospheric distillation, the vacuum residues (VR) originating from a vacuum distillation, deasphalted oils, deasphalting resins, asphalts or deasphalting pitches, residues originating from conversion processes such as coking, aromatic extracts originating from lubricant base production chains, bituminous sands or derivatives thereof, oil shales or derivatives thereof, source rock oils or derivatives thereof, alone or in a mixture.

In the present invention, the feedstocks that are treated are preferably atmospheric residues (RA) or vacuum residues (VR), or residues from conversion processes, or also any mixtures of these different types of residues.

Moreover, the hydrocarbon feedstock treated in the process according to the invention is sulphur-containing.

Its sulphur content is at least 0.5% by weight, preferentially at least 1% by weight, even more preferentially at least 2% by weight.

Moreover, the hydrocarbon-containing feedstock treated in the process according to the invention can contain asphaltenes. Its asphaltene content can be at least 1% by weight, preferably at least 2% by weight.

These feedstocks can be used as such or diluted with a co-feedstock. This co-feedstock can be a hydrocarbon-containing fraction or a mixture of lighter hydrocarbon-containing fractions, that can preferably be selected from the products originating from a fluidized-bed catalytic cracking (FCC) process, a light cut oil (or light cycle oil, LCO), a heavy cut oil (heavy cycle oil, HCO), a decanted oil (DO), an FCC residue, a gas oil fraction, in particular a fraction obtained by atmospheric or vacuum distillation, such as for example vacuum gas oil, or that can also come from another refining processes.

The co-feedstock can also be constituted by one or more cuts originating from the carbon or biomass liquefaction process, aromatic extracts, or any other hydrocarbon-containing cuts or also non-petroleum feedstocks such as pyrolysis oil.

The heavy hydrocarbon-containing feedstock according to the invention can represent at least 50%, preferentially 70%, more preferentially at least 80%, and even more preferentially at least 90% by weight of the total hydrocarbon-containing feedstock treated by the process according to the invention.

Hydrotreatment Stage (a)

The heavy hydrocarbon-containing feedstock is subjected according to the process of the present invention to a fixed-bed hydrotreatment stage (a) in which the feedstock and hydrogen are brought into contact on a hydrotreatment catalyst.

By hydrotreatment, commonly called HDT, is meant the catalytic treatments with supply of hydrogen making it possible to refine, i.e. to substantially reduce the content of metals, sulphur and other impurities contained in the hydrocarbon-containing feedstock while increasing the hydrogen-to-carbon ratio of the feedstock.

The hydrotreatment is accompanied by the formation of cuts lighter than the starting feedstock. The hydrotreatment comprises in particular hydrodesulphurization reactions (commonly called HDS), hydrodenitrogenation reactions (commonly called HDN) and hydrodemetallization reactions (commonly called HDM), accompanied by hydrogenation, hydrodeoxygenation, hydrodearomatization, hydroisomerization, hydrodealkylation, hydrocracking, hydrodeasphalting and Conradson carbon reduction reactions.

According to a preferred variant, the hydrotreatment stage (a) comprises a first stage (a1) of hydrodemetallization (HDM) carried out in one or more hydrodemetallization zones in fixed beds, and a subsequent second hydrodesulphurization (HDS) stage (a2) carried out in one or more hydrodesulphurization zones in fixed beds.

According to a preferred embodiment, the fixed bed hydrotreatment zone can comprise switchable reactors, for example switchable guard reactors which, according to a sequence including stages of operation, stopping, unloading and replacement of the catalyst, allow a longer cycle duration, in particular for feedstocks with high metal contents.

During said first hydrodemetallization stage (a1), the feedstock and the hydrogen are brought into contact on a hydrodemetallization catalyst, under hydrodemetallization conditions, then during said second hydrodesulphurization stage (a2), the effluent from the first hydrodemetallization stage (a1) is brought into contact with a hydrodesulphurization catalyst, under hydrodesulphurization conditions. This process, known by the name HYVAHL-F™, is for example described in the U.S. Pat. No. 5,417,846.

Between the hydrodemetallization stage and the hydrodesulphurization stage, a person skilled in the art sometimes defines a transition zone. Whether during the hydrodemetallization stage, during the transition stage, or during the hydrodesulphurization stage, all the types of hydrotreatment reaction are produced. However, these names originate in particular from the fact that the majority of the metals are removed during the hydrodemetallization stage, whilst during the hydrodesulphurization stage, the majority of the reactions taking place are of the hydrodesulphurization type.

The hydrotreatment stage (a) according to the invention can advantageously be implemented at a temperature comprised between 300° C. and 500° C., preferably between 350° C. and 420° C., and under an absolute pressure comprised between 2 MPa and 35 MPa, preferably between 11 MPa and 20 MPa.

Usually, the space velocity of the hydrocarbon-containing feedstock, commonly called LHSV, which is defined as being the volume flow rate of the feedstock under the process conditions divided by the total volume of the reactor, can be comprised within a range from 0.1 $h^{-1}$ to $h^{-1}$, preferentially from 0.1 $h^{-1}$ to 2 $h^{-1}$, and more preferentially from 0.1 $h^{-1}$ to 0.45 $h^{-1}$. The quantity of hydrogen mixed with the feedstock can be comprised between 100 and 5000 normal cubic metres ($Nm^3$) per cubic metre ($m^3$) of liquid feedstock, preferentially between 200 $Nm^3/m^3$ and 2000 $Nm^3/m^3$, and more preferentially between 300 $Nm^3/m^3$ and 1500 $Nm^3/m^3$. The hydrotreatment stage (a) can be carried out industrially in one or more reactors with descending flow of liquid.

The hydrotreatment catalysts used are generally granular catalysts comprising, on a support, at least one metal or metal compound having a hydrodehydrogenating function. These catalysts can advantageously be catalysts comprising at least one metal of group VIII, chosen generally in the group constituted by nickel and cobalt, and/or at least one metal of group VIB, preferably molybdenum and/or tungsten.

It is possible to use for example a catalyst comprising from 0.5% to 10% by weight of nickel, preferably from 1% to 5% by weight of nickel (expressed as nickel oxide NiO), and from 1% to 30% by weight of molybdenum, preferably from 5% to 20% by weight of molybdenum (expressed as molybdenum oxide $MoO_3$) on a mineral support.

This support can for example be selected from the group constituted by alumina, silica, silica-aluminas, magnesia, clays and mixtures of at least two of these minerals.

In the case of a hydrotreatment stage including a hydrodemetallization stage (HDM), then a hydrodesulphurization stage (HDS), specific catalysts adapted to each stage are preferably used.

Catalysts that can be used in the HDM stage are for example given in patent documents EP 0113297, EP 0113284, U.S. Pat. No. 5,221,656, U.S. Pat. No. 5,827,421, U.S. Pat. No. 7,119,045, U.S. Pat. No. 5,622,616 and U.S. Pat. No. 5,089,463. HDM catalysts are preferably used in switchable reactors.

Catalysts that can be used in the HDS stage are for example given in patent documents EP 0113297, EP 0113284, U.S. Pat. No. 6,589,908, U.S. Pat. No. 4,818,743 or U.S. Pat. No. 6,332,976.

It is also possible to use an active mixed HDM and HDS catalyst, both for the HDM section and for the HDS section as described in patent document FR 2940143.

Prior to the injection of the feedstock, the catalysts used in the process according to the present invention are preferably subjected to an in-situ or ex-situ sulphurization treatment.

Intermediate Separation Stage (b)

The effluent obtained at the end of fixed-bed hydrotreatment stage (a) undergoes at least one separation stage, optionally completed by other additional separation stages, making it possible to separate at least one light fraction and at least one heavy fraction. By "light fraction", is meant a fraction in which at least 90% of the compounds have a boiling point less than 350° C.

By "heavy fraction", is meant a fraction in which at least 90% of the compounds have a boiling point greater than or equal to 350° C. Preferably, the light fraction obtained during separation stage (b) comprises a gaseous phase and at least one light hydrocarbon fraction of the naphtha, kerosene and/or diesel type. The heavy fraction preferably comprises a vacuum distillate fraction and a vacuum residue fraction and/or an atmospheric residue fraction.

The separation stage (b) can be implemented by any method known to a person skilled in the art. This method can be selected from a high or low pressure separation, high or low pressure distillation, high or low pressure stripping, liquid/liquid extraction, and combinations of these different methods that can be operated at different pressures and temperatures.

According to a first embodiment of the present invention, the effluent originating from the hydrotreatment stage (a) undergoes a separation stage (b) with decompression. According to this embodiment, the separation is preferably carried out in a fractionation section which can firstly comprise a high pressure high temperature (HPHT) separator, and optionally a high pressure low temperature (HPLT) separator, then optionally followed by an atmospheric distillation section and/or by a vacuum distillation section.

Preferably, said heavy fraction can be fractionated by atmospheric distillation into at least one atmospheric distillate fraction, preferably containing at least one light hydrocarbon fraction of the naphtha, kerosene and/or diesel type, and an atmospheric residue fraction. At least a part of the atmospheric residue fraction can also be fractionated by vacuum distillation to a vacuum distillate fraction, preferably containing vacuum gas oil, and a vacuum residue fraction.

At least a part of the vacuum residue fraction and/or of the atmospheric residue fraction is advantageously sent into the hydrocracking stage (c). A part of the vacuum gas oil, of the atmospheric and/or vacuum residue can also be recycled in the hydrotreatment stage (a) or be drawn off and sent to the product tanks or to another refining unit (catalytic cracking or hydrocracking of vacuum gas oil for example).

According to a second embodiment, a part of the effluent originating from the hydrotreatment stage (a) undergoes a separation stage (b) without decompression of at least one heavy fraction. According to this embodiment, the effluent from the hydrotreatment stage (a) is sent into a separation section, generally into an HPHT separator, having a cut point between 200° C. and 400° C. making it possible to obtain at least one light fraction and at least one heavy fraction. Generally, the separation is preferably not carried out according to a precise cut point, rather it resembles a separation of the flash type.

The heavy fraction can then be directly sent, in a mixture with a hydrogen-rich gas, into the hydrocracking stage (c).

The light fraction can undergo other separation stages. Advantageously, it can be subjected to an atmospheric distillation making it possible to obtain a gaseous fraction, at least one light hydrocarbon liquid fraction of the naphtha, kerosene and/or diesel type and a vacuum distillate fraction, the latter being able to be sent at least in part into the hydrocracking stage (c). Another part of the vacuum distillate can be used as fuel oil fluxing agent. Another part of the vacuum distillate can be upcycled by being subjected to a stage of hydrocracking and/or catalytic cracking in a fluidized bed.

Even more advantageously, the light fraction originating from the HPHT separator can be cooled down, then introduced into a high pressure low temperature (HPLT) separator in which a gas fraction containing hydrogen and a liquid fraction containing distillates are separated. This liquid fraction containing distillates can be sent to the hydrocracking stage c) via a pump, in a mixture with the liquid fraction originating from the HPHT separator. Alternatively, this liquid fraction containing distillates can be sent to the final separation stage d) which also treats the effluent originating from the hydrocracking stage c)

The separation without decompression allows better thermal integration, and results in savings in terms of energy and equipment. Moreover, this embodiment has technical and economic advantages, given that it is not necessary to increase the pressure of the flows after separation before the subsequent hydrocracking stage.

As intermediate fractionation without decompression is simpler than fractionation with decompression, the investment cost is therefore advantageously reduced.

The gaseous fractions originating from the separation stage preferably undergo a purification treatment in order to recover the hydrogen and recycle it to the hydrotreatment and/or hydrocracking reactors. The presence of the intermediate separation stage, between the hydrotreatment stage (a) and the hydrocracking stage (c), advantageously makes it possible to have two independent hydrogen circuits available, one linked to the hydrotreatment, the other to the hydrocracking, and which can be linked to one another, as required.

The make-up hydrogen can be added in the hydrotreatment section, or in the hydrocracking section, or in both.

The recycling hydrogen can feed the hydrotreatment section or the hydrocracking section or both. A compressor can optionally be common to both hydrogen circuits. Being able to link the two hydrogen circuits makes it possible to optimize the management of hydrogen and to limit investments in terms of compressors and/or purification units of the gaseous effluents. The different embodiments of hydrogen management that can be used in the present invention are described in the patent application FR 2957607.

The light fraction obtained at the end of separation stage (b), which comprises hydrocarbons of the naphtha, kerosene and/or diesel type or others, in particular LPG and vacuum gas oil, can be upcycled according to the methods well known to a person skilled in the art.

The products obtained can be incorporated in fuel formulations (also called fuel "pools"), or undergo additional refining stages. The naphtha, kerosene, gas oil and vacuum gas oil fractions can be subjected to one or more treatments, for example hydrotreatment, hydrocracking, alkylation, isomerization, catalytic reforming, catalytic or thermal cracking, in order to bring them, separately or in a mixture, to the required specifications which can relate to the sulphur content, smoke point, octane number, cetane number, etc.

Hydrocracking Stage c)

At least one heavy fraction originating from separation stage b) is mixed with a hydrogen-rich gas. This mixture feeds the hybrid-bed hydrocracking section. The hybrid-bed hydrocracking section can be available in three variants:

- hydrocracking zone comprising an ebullating-bed reactor followed by a hybrid-bed reactor,
- hydrocracking zone comprising a hybrid-bed reactor followed by a hybrid-bed reactor,
- hydrocracking zone comprising a single hybrid-bed reactor.

In the variants comprising two reactors, at least one inter-stage separator making it possible to separate a gas fraction and a liquid fraction can be installed between two hydrocracking reactors, so as to send to the second reactor only the liquid fraction originating from the inter-stage separator.

The "dispersed" catalyst which occurs in the hybrid-bed reactor is a sulphide catalyst preferably containing at least one element selected from the group formed by Mo, Fe, Ni, W, Co, V, Ru. These catalysts are generally monometallic or bimetallic (combining for example a non-noble element of group VIIIB (Co, Ni, Fe) and an element of group VIB (Mo, W). The catalysts used can be powders of heterogeneous solids (such as natural minerals, iron sulphate etc.), dispersed catalysts originating from water-soluble precursors such as phosphomolybdic acid, ammonium molybdate, or a mixture of Mo or Ni oxide with aqueous ammonia.

Preferably, the catalysts used originate from precursors that are soluble in an organic phase (oil-soluble catalysts).

The precursors are organometallic compounds of Mo, Co, Fe, or Ni naphthenates or Mo octoates, or multi-carbonyl compounds of these metals, for example Mo or Ni 2-ethyl hexanoates, Mo or Ni acetylacetonate, Mo or W salts of C7-C12 fatty acids, etc. They can be used in the presence of a surfactant in order to improve the dispersion of the metals when the catalyst is bimetallic. The catalysts are in the form of dispersed particles, colloidal or not colloidal depending on the nature of the catalyst. Such precursors and catalysts that can be used in the process according to the invention are widely described in the literature.

In general, the catalysts are prepared before being injected into the feedstock. The preparation process is adapted depending on the state in which the precursor is found, and on its nature. In all cases, the precursor is sulphurized (ex situ or in situ) in order to form the dispersed catalyst in the feedstock.

For the preferred case of so-called oil-soluble catalysts, in a typical process, the precursor is mixed with a carbon-containing feedstock (which can be a part of the feedstock to be treated, an external feedstock, a recycled fraction etc.), the mixture is then sulphurized by adding a sulphur compound (preferably hydrogen sulphide or optionally an organic sulphide such as DMDS in the presence of hydrogen) and heated. The preparations of these catalysts are described in the literature. The particles of "dispersed" catalysts as defined above (powders of metallic mineral compounds or compounds originating from water- or oil-soluble precursors) generally have a size comprised between 1 nanometre and 150 micrometres, preferably between 0.1 and 100 micrometres, and even more preferably between 10 and 80 microns. The catalytic compound content (expressed as a percentage by weight of metallic elements of group VIII and/or of group VIB) is comprised between 0 and 10% by weight, preferably between 0 and 1% by weight.

Additives can be added during the preparation of the dispersed catalyst or to the dispersed catalyst before it is injected into the reactor. These additives are described in the literature. The preferred solid additives are mineral oxides such as alumina, silica, mixed Al/Si oxides, supported spent catalysts (for example, on alumina and/or silica), containing at least one element of group VIII (such as Ni, Co) and/or at least one element of group VIB (such as Mo, W). Mention may be made, for example, of the catalysts described in the application US2008/177124. Carbon-containing solids with a low hydrogen content (for example 4% hydrogen) such as coke or ground activated carbon, optionally pretreated, can also be used. It is also possible to use mixtures of such additives. The size of particles of the additive is generally comprised between 10 and 750 microns, preferably between 100 and 600 microns. The content of any solid additive present at the inlet of the hybrid-bed hydrocracking reaction zone is comprised between 0 and 10% by weight, preferentially between 1 and 3% by weight, and the content of catalytic compounds (expressed as a percentage by weight of metallic elements of group VIII and/or of group VIB) is comprised between 0 and 10% by weight, preferably between 0 and 1% by weight.

The hybrid-bed reactors used in the hydrocracking zone are therefore constituted by two populations of catalysts, a first population using supported catalysts in the form of extrudates the diameter of which is advantageously comprised between 0.8 and 1.2 mm, generally equal to 0.9 mm or 1.1 mm and a second population of catalyst of the "dispersed" type mentioned above.

The fluidization of the particles of catalysts in the ebullating bed is made possible by the use of an ebullition pump which allows a recycling of liquid, generally inside the reactor. The flow rate of liquid recycled by the ebullition pump is adjusted so that the particles of catalysts are fluidized but not transported, so that these particles therefore remain in the ebullating-bed reactor (with the exception of the catalyst fines which can be formed by attrition and entrained with the liquid since these fines are small in size).

For the ebullating-bed reactor, it is possible to use a standard granular hydrocracking catalyst, generally an extrudate, comprising at least one metal or metal compound having a hydrodehydrogenating function on an amorphous support.

This catalyst can be a catalyst comprising metals of group VIII, for example nickel and/or cobalt, usually in combination with at least one metal of group VIB, for example molybdenum and/or tungsten. It is possible, for example, to use a catalyst comprising from 0.5% to 10% by weight of nickel and preferably from 1% to 5% by weight of nickel (expressed as nickel oxide NiO) and from 1% to 30% by weight of molybdenum, preferably from 5% to 20% by weight of molybdenum (expressed as molybdenum oxide MoO3) on an amorphous mineral support.

This support can for example be selected from the group constituted by alumina, silica, the silica-aluminas, magnesia, clays and the mixtures of at least two of these minerals. This support can also contain other compounds and for example oxides selected from the group constituted by boron oxide, zirconium, titanium oxide, phosphoric anhydride. An alumina support is usually used and very often an alumina support doped with phosphorus and optionally boron.

When phosphoric anhydride P2O5 is present, its concentration is usually less than 20% by weight and usually less than 10% by weight. When boron trioxide B2O3 is present, its concentration is usually less than 10% by weight. The alumina used is usually a γ (gamma) or η (eta) alumina. This catalyst can be in the form of extrudates. The total content of oxides of metals of groups VI and VIII can be comprised between 5% and 40% by weight, preferably between 7% and 30% by weight, and the weight ratio expressed as metallic oxide between a metal (or metals) of group VI and a metal (or metals) of group VIII is comprised between 20 and 1, preferably between 10 and 2.

The spent catalyst can be replaced in part by fresh catalyst, generally by drawing off at the bottom of the reactor and introducing fresh or new catalyst at the top of the reactor at regular time intervals, i.e. for example in puffs or continuously or virtually continuously. It is also possible to introduce the catalyst at the bottom and draw it off at the top of the reactor. It is possible, for example, to introduce fresh catalyst every day. The rate of replacement of the spent catalyst with fresh catalyst can be for example from approximately 0.05 kilogram to approximately 10 kilograms per cubic metre of feedstock.

This drawing-off and this replacement are carried out using devices allowing the continuous operation of this hydrocracking stage. The hydrocracking reactor usually comprises a recirculation pump making it possible to maintain the catalyst in an ebullating bed by continuous recycling of at least a part of the liquid drawn off at the top of the reactor and reinjected into the bottom of the reactor. It is also possible to send the spent catalyst drawn off from the reactor into a regeneration zone in which the carbon and the sulphur that it contains are removed before its reinjection into hydrocracking stage c) For a reactor operating as an ebullating bed during hydrocracking stage c) its implementation can resemble that of the H-OIL® process as described for example in the U.S. Pat. No. 6,270,654.

Irrespective of the configuration of the hydrocracking zone, the operating conditions of the hydrocracking zone are in general as follows:

- a partial pressure of hydrogen varying from 2 to 35 MPa and preferentially from 10 to MPa,
- a temperature comprised between 330° C. and 550° C., preferably from 350° C. to 500° C., even more preferentially between 370° C. and 480° C.,
- a "reactor" hourly space velocity (reactor LHSV, i.e. ratio between the volume flow rate of feedstock and the reactor volume) comprised between 0.1 and 10 h−1, preferably from 0.1 h to 5 h−1 and more preferably between 0.1 and 2 h−1,
- an "ebullating-bed catalyst" hourly space velocity for the ebullating-bed or hybrid reactors ("ebullating bed catalyst" LHSV, i.e. the ratio between the volume flow rate of feedstock in Sm3/h and the volume in m3 of inactive ebullating bed catalysts, when the expansion rate of the ebullating bed is zero) comprised between 0.1 and 5 h−1, preferably from 0.1 h to 3 h−1 and more preferably between 0.1 and 1 h−1,
- a catalytic compound content in the "dispersed" catalysts for the hybrid-bed reactors (expressed as a percentage by weight of metallic elements of group VIII and/or of group VIB) comprised between 0 and 10% by weight, preferably between 0 and 1% by weight
- a hydrogen/feedstock ratio comprised between 50 and 5000 Nm3/m3, usually of approximately 100 to approximately 1500 Nm3/m3, with a preferred range between 500 and 1300 Nm3/m3.

The operating conditions of the hydrocracking zone in at least one reactor containing a "dispersed" catalyst coupled with the fact that the feedstock has been hydrotreated beforehand in hydrotreatment stage a), then separated in separation stage b), make it possible to obtain a conversion rate comprised between 30 and 100%, preferably between 40 and 80% and a hydrodesulphurization rate between 70 and 100%, preferably between 85 and 99%.

The above-mentioned conversion rate is defined as being the quantity of compounds having a boiling point greater than 520° C. in the initial hydrocarbon-containing feedstock, minus the quantity of compounds having a boiling point greater than 520° C. in the hydrocarbon-containing effluent obtained at the end of hydrocracking stage c), all divided by the quantity of compounds having a boiling point greater than 520° C. in the initial hydrocarbon-containing feedstock. A high conversion rate is advantageous insofar as this conversion rate illustrates the production of conversion products, mainly of atmospheric distillates and/or of vacuum distillates of the naphtha, kerosene and diesel type, in significant quantities.

The abovementioned hydrodesulphurization rate is defined as being the quantity of sulphur in the initial hydrocarbon-containing feedstock, minus the quantity of sulphur in the hydrocarbon-containing effluent obtained at the end of hydrocracking stage c), all divided by the quantity of sulphur in the initial hydrocarbon-containing feedstock.

Stage d) of Separation of the Hydrocracking Effluent

The process according to the invention comprises a separation stage d) making it possible to obtain at least one gaseous fraction and at least one liquid hydrocarbon-containing fraction. The effluent obtained at the end of hydrocracking stage c) comprises a liquid fraction and a gaseous fraction containing gas, in particular H2, H2S, NH3, and C1-C4 hydrocarbons. This gaseous fraction can be separated from the hydrocarbon-containing effluent using separation devices well known to a person skilled in the art, in particular using one or more separator tanks that can operate at different pressures and temperatures, optionally combined with a steam or hydrogen stripping means, and generally one or more distillation columns.

The effluent obtained at the end of hydrocracking stage c) is advantageously separated in at least one separator tank into at least one gaseous fraction and at least one liquid fraction. These separators can, for example, be high pressure high temperature (HPHT) separators and/or high pressure low temperature (HPLT) separators.

After optional cooling, this gaseous fraction is preferably treated in a hydrogen purification means so as to recover the hydrogen not consumed during the hydrotreatment and hydrocracking reactions.

The hydrogen purification means can be washing with amines, a membrane, a system of the PSA (pressure swing adsorption) type, or several of these means arranged in series. The purified hydrogen can then advantageously be recycled in the process according to the invention, after optional recompression. The hydrogen can be introduced at the inlet of hydrotreatment stage (a) and/or at different points during hydrotreatment stage a) and/or at the inlet of hydrocracking stage (c) and/or at different points during hydrocracking stage c). Separation stage d) can also comprise a steam or hydrogen stripping stage, generally steam, in order to remove at least one gas fraction rich in hydrogen sulphide (H2S).

Separation stage d) can also comprise an atmospheric distillation and/or a vacuum distillation. Advantageously, separation stage (d) also comprises at least one atmospheric distillation, in which the liquid hydrocarbon-containing fraction(s) obtained after separation is (are) fractionated by atmospheric distillation into at least one atmospheric distillate fraction and at least one atmospheric residue fraction.

The atmospheric distillate fraction can contain fuel bases (naphtha, kerosene and/or diesel) that can be upcycled commercially, for example in a refinery for the production of automobile and aviation fuels.

Moreover, separation stage (d) of the process according to the invention can advantageously also comprise at least one vacuum distillation in which the liquid hydrocarbon-containing fraction(s) obtained after separation and/or the atmospheric residue fraction obtained after atmospheric distillation is (are) fractionated by vacuum distillation into at least one vacuum distillate fraction and at least one vacuum residue fraction.

Stage d) of separation of the effluent originating from the hydrocracking stage can be carried out either in a summary manner, making it possible to obtain one or two liquid fractions, or in a more complete manner, making it possible to obtain at least three liquid fractions. The separation d) carried out in a more complete manner thus makes it possible to obtain atmospheric and/or vacuum distillate cuts (naphtha, kerosene, gas oil, vacuum gas oil for example) completely separated from the atmospheric and/or vacuum residue. The manner in which this separation stage is carried out determines the sequence of the optional stages e) and f).

According to a first embodiment corresponding to a separation that is, rather, complete, separation stage (d) comprises a high pressure hot drum, a high pressure cold drum, a low pressure hot drum, a low pressure cold drum, then on a liquid fraction originating from the separator tanks, atmospheric distillation, in which the liquid hydrocarbon-containing fraction(s) obtained after separation is (are) fractionated by atmospheric distillation into at least one atmospheric distillate fraction and at least one atmospheric residue fraction, then a vacuum distillation in which the atmospheric residue fraction obtained after atmospheric distillation is fractionated by vacuum distillation into at least one vacuum distillate fraction and at least one vacuum residue fraction. The vacuum distillate fraction typically contains fractions of the vacuum gas oil type. At least a part of the atmospheric residue fraction and/or of the vacuum distillate fraction, and/or of the vacuum residue fraction, can be recycled in hydrocracking stage c) or hydrotreatment stage a) or be sent to product tanks or also be treated in another refining unit (catalytic cracking or vacuum distillate hydrocracking for example). According to a second embodiment corresponding to a summary separation, separation stage (d) comprises a high pressure hot drum, a high pressure cold drum, a low pressure hot drum, a low pressure cold drum, then on a liquid fraction originating from the separator tanks, a steam stripping column making it possible to remove at least one light fraction rich in hydrogen sulphide. This second embodiment proves advantageous during the implementation of the optional stages e) of treatment of the sediments and residues of catalysts and f) of separation of the liquid fraction originating from stage d). Thus, the distillation columns of stage f) are less subject to clogging since they are treating a liquid fraction the sediment content of which has been reduced during stage e). It is therefore advantageous to carry out stage d) in summary fashion utilizing a minimum of equipment which treats a hydrocarbon-containing fraction that may contain sediments.

At the end of separation stage (d), at least one liquid hydrocarbon-containing fraction is obtained, having a sulphur content less than or equal to 0.5% by weight, preferentially less than or equal to 0.3% by weight, and more preferentially less than or equal to 0.1% by weight. This liquid hydrocarbon-containing fraction can advantageously serve as fuel oil base or as fuel oil, in particular as bunker oil base or as bunker oil, with a low sulphur content corresponding to the new recommendations of the International Maritime Organization. Advantageously, all of the liquid hydrocarbon-containing effluent obtained at the end of separation stage (d) can have a sulphur content less than or equal to 0.5% by weight, and preferentially less than or equal to 0.3% by weight.

This liquid hydrocarbon-containing effluent can, at least in part, advantageously be used as fuel oil bases or as fuel oil, in particular as bunker oil base or as bunker oil, with a low sulphur content corresponding to the new recommendations of the International Maritime Organization.

By "fuel oil", is meant in the invention a hydrocarbon-containing feedstock that can be used as fuel. By "fuel oil base", is meant in the invention a hydrocarbon-containing feedstock which, mixed with other bases, constitutes a fuel oil. Depending on the origin of these bases, in particular depending on the type of crude oil and on the type of refining, the properties of these bases, in particular their sulphur content and their viscosity, vary widely.

One of the benefits of the sequence of a fixed-bed hydrotreatment, then hydrocracking in at least one reactor containing a "dispersed" catalyst resides in the fact that the feedstock of the hybrid-bed hydrocracking reactor is already at least partially hydrotreated. In this way, it is possible to obtain with equivalent conversion, hydrocarbon-containing effluents of better quality, in particular with lower sulphur contents. Furthermore, the consumption of catalysts, supported and dispersed, in the hybrid-bed hydrocracking stage is greatly reduced compared with a process without prior fixed-bed hydrotreatment.

Sediment Treatment Stage e)

The hydrocarbon-containing effluent obtained at the end of stage d) of separation of the hydrocracking effluent, and in particular the heaviest liquid fraction obtained, generally a fraction of the atmospheric residue or vacuum residue type, can contain sediments and residues of catalysts. At least a part of the sediments can be constituted by precipitated asphaltenes resulting from severe hydrocracking of a feedstock of the petroleum residue type. The residues of catalysts can be fines originating from the attrition of catalysts of the extrudate type in the utilization of an ebullating-bed hydrocracking reactor. The phenomenon of attrition of catalysts of the extrudate type can also be present in a hybrid bed. Another part of the catalyst residues originates from the "dispersed" catalyst.

In order to obtain a fuel oil or a fuel oil base corresponding to the recommendations relating to a sediment content after ageing (IP390) of less than or equal to 0.1%, the process according to the invention can comprise an additional stage consisting of separating the sediments and the residues of catalysts from the liquid hydrocarbon-containing effluent after separation stage d).

Depending on the hydrocracking conditions, the sediment content in the heavy fraction varies. From an analytical point of view, a distinction is made between the existing sediments (IP375) and the sediments after ageing (IP390) which include the potential sediments. Depending on the hydrocracking conditions, it may therefore be necessary to carry out, during sediment treatment stage e), a maturation stage upstream of the solid-liquid separation technique mentioned previously. This maturation stage makes it possible to convert the potential sediments to existing sediments so that the mixture of the existing sediments after the treatment can be separated more effectively and thus, after treatment, meet the requirement for a sediment content after ageing (IP390) of 0.1% by weight maximum.

The maturation stage consists of applying a certain residence time, between 1 and 1500 minutes, preferably between 30 and 300 minutes, more preferentially between 60 and 180 minutes, to the heavy fraction heated beforehand at a temperature between 100 and 500° C., preferably between 150 and 350° C., and more preferentially between 200 and 300° C.

The pressure of the maturation stage is less than 200 bar, preferably less than 100 bar, more preferentially less than 30 bar, and even more preferentially less than 15 bar.

This maturation stage can be carried out, for example with an exchanger or a furnace then one or more enclosures in series or in parallel such as a horizontal or vertical drum, optionally with a decantation function for removing a part of the heaviest solids, and/or a piston reactor. A stirred and heated vessel can also be used, and can optionally be equipped with a drawing-off device at the bottom for removing a part of the heaviest solids. Optionally, the maturation stage can be carried out in the presence of an inert gas (nitrogen for example) or oxidizing gas (oxygen, air or nitrogen-depleted air). The utilization of an oxidizing gas makes it possible to accelerate the maturation process. According to this option, there is thus an introduction of a gas in a mixture with the liquid fraction originating from stage d) before the maturation then separation of this gas after the maturation so as to obtain a liquid fraction leaving the maturation stage and send it into the stage of physical separation of the sediments.

One of the challenges of the utilization of "dispersed" catalysts in hydrocracking processes is the cost of this "dispersed" catalyst. The present invention limits the cost of hydrocracking catalysts due to the upstream hydrotreatment stage. It may however be advantageous to recover, at least partially, the dispersed catalyst present in the heavy cuts. This stage of recovery of the dispersed catalyst can therefore be carried out consecutively or simultaneously to the stage of separation of the sediments and catalyst residues.

The process according to the invention can therefore also comprise a treatment stage e) allowing the separation of the sediments and catalyst residues, optionally coupled, simultaneously or consecutively, to a stage of recovery of the dispersed catalyst.

During this stage e), at least a part of the atmospheric residue and/or vacuum residue fractions is subjected to a separation of the sediments and catalyst residues, optionally coupled, simultaneously or consecutively, to a stage of recovery of the "dispersed catalyst", by using, during stage e), after the maturation making it possible to convert the potential sediments to existing sediments, at least one filter, a separation on membranes, a bed of filtering solids of the organic or inorganic type, electrostatic precipitation, a centrifugation system, in-line decantation, and drawing-off by means of an endless screw. The sediment treatment stage e) is therefore an intelligent coupling of a first maturation stage making it possible to convert the potential sediments to existing sediments then a second stage of physical solid-liquid separation making it possible to draw off at least part of the mixture of the existing sediments. At the end of sediment treatment stage e), at least one liquid hydrocarbon-containing fraction is obtained, having a sulphur content less than or equal to 0.5% by weight, preferentially less than or equal to 0.3% by weight, and more preferentially less than or equal to 0.1% by weight. Furthermore, the liquid hydrocarbon-containing fraction originating from stage e) of treatment of sediments is characterized by a sediment content after ageing (IP390) of less than 0.1% by weight.

This liquid hydrocarbon-containing fraction can advantageously serve as fuel oil base or as fuel oil, in particular as bunker oil base or as bunker oil, with a low sulphur content and with a low sediment content after ageing corresponding to the new recommendations of the International Maritime Organization and of standard ISO 8217 for marine fuels.

Advantageously, all of the liquid hydrocarbon-containing effluent obtained at the end of sediment treatment stage e) has a sulphur content less than or equal to 0.5% by weight, and preferentially less than or equal to 0.3% by weight.

Advantageously, all of the liquid hydrocarbon-containing effluent obtained at the end of sediment treatment stage e) has a sediment content after ageing (IP390) of less than 0.1% by weight.

Stage f) of Separation of the Effluent from the Sediment Treatment Stage

The process according to the invention comprises a separation stage f) making it possible to obtain at least one liquid hydrocarbon-containing fraction. The effluent obtained at the end of sediment treatment stage d) comprises at least one liquid fraction. The composition of this liquid fraction depends on the manner in which stage d) of separation of the hydrocracking effluent has been carried out. If stage d) has been carried out in a summary manner, the effluent originating from stage e) therefore contains a mixture of distillates and residues that should be separated for upcycling of each of the cuts, by utilizing at least one distillation column. If stage d) has been carried out in a more complete manner, only one liquid fraction of the vacuum residue and/or atmospheric residue type has been sent to sediment treatment stage e). In the case of a more complete separation d), the liquid fraction originating from stage e) may therefore not require optional stage f).

No description is given of all the separation equipment that can be utilized during separation stage f) since it is well known to a person skilled in the art and already mentioned during separation stages b) and d) (separator tanks, columns, etc.)

At the end of separation stage (f), at least one liquid hydrocarbon-containing fraction is obtained, having a sulphur content less than or equal to 0.5% by weight, preferentially less than or equal to 0.3% by weight, and more preferentially less than or equal to 0.1% by weight. Furthermore, the liquid hydrocarbon-containing fraction originating from separation stage f) is characterized by a sediment content after ageing (IP390) of less than 0.1% by weight. This liquid hydrocarbon-containing fraction can advantageously serve as fuel oil base or as fuel oil, in particular as bunker oil base or as bunker oil, with a low sulphur content and with a low sediment content after ageing corresponding to the new recommendations of the International Maritime Organization and of the standard ISO 8217 for marine fuels.

By "fuel oil", is meant in the invention a hydrocarbon-containing feedstock that can be used as fuel. By "fuel oil base", is meant in the invention a hydrocarbon-containing feedstock which, mixed with other bases, constitutes a fuel oil. Depending on the origin of these bases, in particular depending on the type of crude oil and of the type of refining, the properties of these bases, in particular their sulphur content and their viscosity, vary widely.

DETAILED DESCRIPTION OF THE FIGURES

FIG. 1 represents a process according to the invention with intermediate separation with decompression. The introduction of the feedstock (10) up to the outlet of the effluent (42) represents the hydrotreatment zone and this zone is described briefly as it may exist in numerous variants known to a person skilled in the art.

In FIG. 1, the feedstock (10), preheated in the enclosure (12), mixed with recycled hydrogen (14) and make-up hydrogen (24) preheated in the enclosure (16), is introduced via the pipeline (18) into the guard zone represented by the two reactors Ra and Rb. These reactors are generally switchable reactors in the sense that they operate according to a series of cycles each comprising four successive stages:

a first stage (stage i) during which the feedstock passes through the reactor Ra, then the reactor Rb successively, a second stage (stage ii) during which the feedstock only passes through the reactor Rb, the reactor Ra being bypassed for regeneration and/or replacement of the catalyst, a third stage (stage iii) during which the feedstock passes through the reactor Rb, then the reactor Ra successively, a fourth stage (stage iv) during which the feedstock only passes through the reactor Ra, the reactor Rb being bypassed for regeneration and/or replacement of the catalyst.

The cycle can then recommence.

BRIEF DESCRIPTION OF THE DRAWINGS

FIG. 1 represents a process according to the invention with intermediate separation with decompression.

Figure 2:
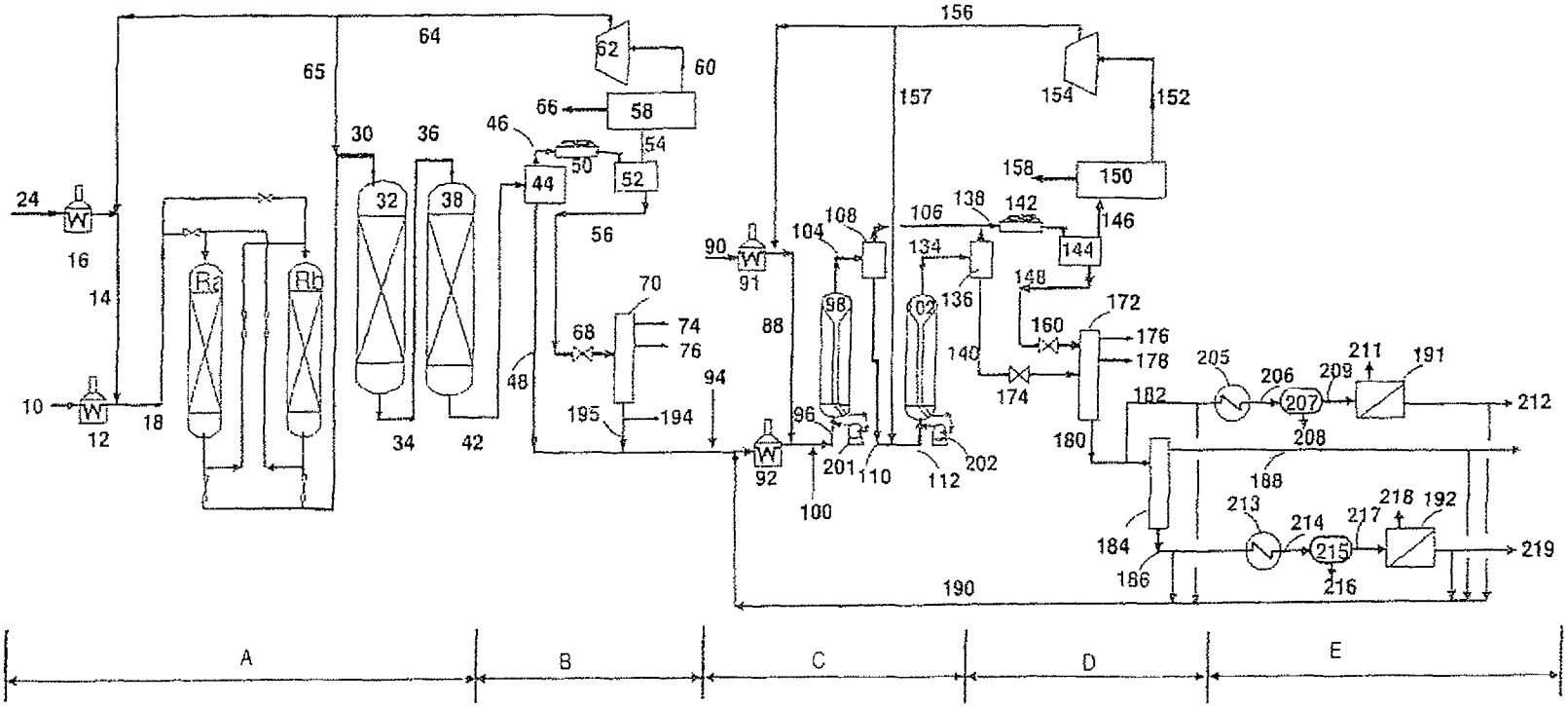
FIG. 2 shows a diagrammatic view of the process according to the invention in a variant in which the zone of separation of the effluent from the hydrotreatment zone is simplified. For the sake of clarity, the limits of each stage have been represented symbolically in FIGS. 1 and 2: "A" denotes the hydrotreatment zone, "B" denotes the intermediate separation zone, "C" denotes the hydrocracking zone and "D" denotes the zone of separation of the effluent from the hydrocracking zone and "E" denotes the sediment treatment zone.

FIG. 2 represents another process according to the invention with intermediate separation without decompression.

Returning to FIG. 1, the effluent leaving the guard reactor(s) (Ra, Rb) is optionally remixed with hydrogen arriving via the pipeline (65) in an HDM reactor (32) which contains a fixed catalyst bed. For the sake of clarity, a single HDM reactor (32) and a single HDS reactor (38) are shown in the figure, but the HDM and HDS section can comprise several HDM and HDS reactors in series.

The effluent from the HDM reactor is drawn off via the pipeline (34), then sent into the first HDS reactor (38) where it passes through a fixed catalyst bed.

The effluent originating from the hydrotreatment stage is sent via the line (42) into a high pressure high temperature (HPHT) separator (44) from which a gaseous fraction (46) and a liquid fraction (48) are recovered. The cut point is generally between 200 and 400° C. The gaseous fraction (46) is sent, generally via an exchanger (not shown) or an air cooler (50) for cooling, to a high pressure low temperature (HPLT) separator (52) from which a gaseous fraction (54) containing the gases (H2, H2S, NH3, C1-C4 hydrocarbons etc.) and a liquid fraction (56) are recovered.

The gaseous fraction (54) originating from the high pressure low temperature (HPLT) separator (52) is treated in the hydrogen purification unit (58) from which the hydrogen (60) is recovered in order to recycle it via the compressor (62) and the line (65) to the reactors (32) and/or (38) or via the line (14) to the switchable reactors (Ra, Rb).

The gas containing undesirable nitrogen- and sulphur-containing compounds is discharged from the installation (flow (66)).

The liquid fraction (56) originating from the high pressure low temperature (HPLT) separator (52) is expanded in the device (68) then sent to the fractionation system (70).

Optionally, a medium pressure separator (not shown) after the expander (68) can be installed in order to recover a gaseous fraction which is sent to the purification unit (58), and a liquid phase which is conveyed to the fractionation section (70).

The liquid fraction (48) originating from the high pressure high temperature (HPHT) separator (44) is expanded in the device (72) then sent to the fractionation system (70).

The fractions (56) and (48) can be sent together, after expansion, to the fractionation system (70).

The fractionation system (70) comprises an atmospheric distillation system for producing a gaseous effluent (74), at least one so-called light fraction (76) and containing in particular naphtha, kerosene and diesel and an atmospheric residue fraction (78).

A part of the atmospheric residue fraction can be sent via the line (80) into the hydrocracking reactors (98, 102).

All or part of the atmospheric residue fraction (78) is sent to a vacuum distillation column (82) in order to recover a fraction (84) containing the vacuum residue and a vacuum distillate fraction (86) containing vacuum gas oil.

The vacuum residue fraction (84), optionally mixed with a part of the atmospheric residue fraction (80) and/or with a part of the vacuum distillate fraction (86), is mixed with the recycled hydrogen (88) optionally topped up with make-up hydrogen (90) preheated in the furnace (91). It optionally passes through a furnace (92).

Optionally, a co-feedstock (94) can be introduced.

The heavy fraction is then introduced via the line (96) into the hydrocracking stage at the bottom of the first hybrid-bed reactor (98) operating with ascending flow of liquid and of gas and containing at least one hydrocracking catalyst of the "dispersed" type and a supported catalyst. It should be recalled that in the context of the present invention, a hybrid bed is an ebullating bed which contains a supported catalyst to which a "dispersed" catalyst has been added.

The catalyst of the "dispersed" type is introduced via the pipeline (100) upstream of the first hydrocracking reactor (98). Optionally, the converted effluent (104) originating from the reactor (98) can be subjected to a separation from the light fraction (106) in an inter-stage separator (108).

All or part of the effluent originating (110) from the inter-stage separator (108) is advantageously mixed with additional hydrogen (157), if necessary preheated beforehand (not shown).

This mixture is then injected via the pipeline (112) into a second hydrocracking reactor (102) also in a hybrid bed operating with ascending flow of liquid and of gas containing at least one hydrocracking catalyst of the "dispersed" type and a supported catalyst.

This catalyst of the "dispersed" type has been injected upstream of the first reactor (98), but the make-up could also be carried out upstream of the second reactor (102) via a pipeline (not shown).

The operating conditions, in particular the temperature, in this reactor are selected in order to achieve the sought level of conversion, as described previously.

The effluent from the hydrocracking reactors is sent via the line (134) into a high pressure high temperature (HPHT) separator (136) from which a gaseous fraction (138) and a liquid fraction (140) are recovered.

The gaseous fraction (138) is generally sent, via an exchanger (not shown) or an air cooler (142) for cooling, to a high pressure low temperature (HPLT) separator (144) from which a gaseous fraction (146) containing gases (H2, H2S, NH3, C1-C4 hydrocarbons etc.) and a liquid fraction (148) are recovered.

The gaseous fraction (146) from the high pressure low temperature (HPLT) separator (144) is treated in the hydrogen purification unit (150) from which the hydrogen (152) is recovered in order to be recycled via the compressor (154) and the line (156) and/or the line (157) to the hydrocracking section.

The hydrogen purification unit can be constituted by washing with amines, a membrane, a system of the PSA type.

The gases containing undesirable nitrogen- and sulphur-containing compounds are discharged from the installation (flow (158) which can represent several flows, in particular a flow rich in H2S and one or more purges containing light hydrocarbons (C1 and C2) which can be used as refinery fuel gas).

The liquid fraction (148) from the high pressure low temperature (HPLT) separator (144) is expanded in the device (160) then sent to the fractionation system (172).

Optionally, a medium pressure separator (not shown) after the expander (160) can be installed in order to recover a vapour phase which is sent to the purification unit (150) and/or to a dedicated medium pressure purification unit (not shown), and a liquid phase which is conveyed to the fractionation section (172).

The liquid fraction (140) originating from the high pressure high temperature (HPHT) (136) separation is expanded in the device (174) then sent to the fractionation system (172). Optionally, a medium pressure separator (not shown) after the expander (174) can be installed in order to recover a vapour phase which is sent to the purification unit (150) and/or to a dedicated medium pressure purification unit (not shown)), and a liquid phase which is conveyed to the fractionation section (172).

Obviously, the fractions (148) and (140) can be sent together, after expansion, to the system (172). The fractionation system (172) comprises an atmospheric distillation system for producing a gaseous effluent (176), at least one so-called light fraction (178), containing in particular naphtha, kerosene and diesel, and an atmospheric residue fraction (180).

A part of the atmospheric residue fraction (180) can be drawn off via the line (182) in order to constitute a sought fuel oil base. All or part of the atmospheric residue fraction (180) can be sent to a vacuum distillation column (184) in order to recover a fraction containing the vacuum residue (186) and a vacuum distillate fraction (188) containing vacuum gas oil. Optionally, the atmospheric residue fraction (182) and/or the vacuum residue fraction (186) can be subjected to a stage of treatment and separation of the sediments and catalyst residues. A heavy fraction of the atmospheric residue type (182) is optionally preheated in a furnace or an exchanger (205) so as to reach the temperature necessary for the maturation (conversion of the potential sediments to existing sediments) which takes place in the vessel (207). The function of the vessel (207) is to ensure a residence time necessary for the maturation, it can therefore be a horizontal or vertical drum, a buffer tank, a stirred tank or a piston reactor. The heating function can be integrated in the vessel in the case of a heated stirred tank according to an embodiment that is not shown. The vessel (207) can also allow decantation so as to discharge a part of the solids (208). The flow (209) originating from the maturation is then subjected to a solid-liquid separation (191) so as to obtain a fraction (212) with a reduced sediment content and a fraction (211) rich in sediments. Similarly, a heavy fraction of the vacuum residue type (186) is optionally preheated in a furnace or an exchanger (213) so as to reach the temperature necessary for the maturation which takes place in the vessel (215). The function of the vessel (215) is to ensure a residence time necessary for the maturation, it can therefore be a horizontal or vertical drum, a buffer tank, a stirred tank or a piston reactor. The heating function can be integrated in the vessel in the case of a heated stirred tank according to an embodiment that is not shown. The vessel (215) can also allow decantation so as to discharge a part of the solids (216). The flow (217) originating from the maturation is then subjected to a solid-liquid separation (192) so as to obtain a fraction (219) with a reduced sediment content and a fraction (218) rich in sediments.

According to an embodiment that is not shown, the maturation (207) and (215) devices can operate in the presence of a gas, in particular an oxidizing gas.

According to an embodiment that is not shown, it is also possible to carry out a stage of treatment and separation of the sediments and catalyst residues on a heavy fraction originating from the stage of separation of the effluent, for example on a heavy cut originating from a separator, for example on the flow (140) before or after the expansion (174). An advantageous embodiment that is not shown can consist of carrying out the stage of treatment and separation of the sediments on the flow recovered at the bottom of a stripping column. When the stage of treatment and separation of the sediments and catalyst residues is carried out upstream of a distillation column, this column is less subject to clogging.

At least a part of the flows (188) and/or (212) and/or (219) constitutes one or more sought fuel oil bases, in particular bases for bunker oils with a low sulphur content. A part of the flows (188) and/or (212) and/or (219), before or after the optional stage of treatment and separation of the sediments, can be recycled via the line (190) to the hydrocracking stage, or upstream of the hydrotreatment stage (line not shown).

The recycling of a cut of the vacuum gas oil type (188) upstream of the hydrotreatment can make it possible to reduce the viscosity of the feedstock and thus facilitate pumping. The recycling of a cut of the atmospheric residue type (212) or vacuum residue type (219) upstream of the hydrotreatment or of the hydrocracking can make it possible to increase the overall conversion.

FIG. 2 represents another process according to the invention with intermediate separation without decompression. Essentially only the differences between the process according to FIG. 2 and the process according to FIG. 1 will be described below, the stages of hydrotreatment, hydrocracking and separation after the hydrocracking (and their reference numbers) being moreover strictly identical.

The effluent treated in the hydrotreatment reactors is sent via the line (42) into a high pressure high temperature (HPHT) separator (44) from which a lighter fraction (46) and a residual fraction (48) are recovered. The cut point between these two fractions is generally between 200 and 450° C., and preferentially between 250° C. and 350° C.

The residual fraction (48) is sent directly, after optionally passing through a furnace (92), into the hydrocracking section.

The lighter fraction (46) is sent, generally via an exchanger (not shown) or an air cooler (50) for cooling, to a high pressure low temperature (HPLT) separator (52) from which a gaseous fraction (54) containing gases (H2, H2S, NH3, C1-C4 hydrocarbons etc.) and a liquid fraction (56) are recovered.

The gaseous fraction (54) from the high pressure low temperature (HPLT) separator (52) is treated in the hydrogen purification unit (58) from which the hydrogen (60) is recovered in order to be recycled via the compressor (154) and the lines (64) and (156) to the hydrotreatment section and/or to the hydrocracking section.

The gases containing undesirable nitrogen-, sulphur, and oxygen-containing compounds are discharged from the installation (flow (66)). In this configuration, a single compressor (154) is used to feed all of the reactors requiring hydrogen.

The liquid fraction (56) originating from the high pressure low temperature (HPLT) separator (52) is expanded in the device (68) then sent to the fractionation system (70).

The fractionation system (70) comprises an atmospheric distillation system for producing a gaseous effluent (74), at least one so-called light fraction (76) and containing in particular naphtha, kerosene and diesel and an atmospheric residue fraction (195).

A part of the atmospheric residue fraction can be sent, by means of a pump that is not shown, via the line (195) into the hydrocracking reactors (98, 102), whilst another part of the atmospheric residue fraction (194) can be sent to another process (hydrocracking or FCC or hydrotreatment).

A variant that is not shown but is similar to the diagram of FIG. 2 can consist of not using any fractionation system (70), nor expanding the liquid fraction (56) originating from the cold separator (52). The liquid fraction (56) is then sent to the hydrocracking section, optionally by means of a pump, in a mixture with the heavy fraction (48) originating from the separator (44).

The scope of the invention is not exceeded whether the separation stage is with or without decompression, with variants of the hydrocracking section since this hydrocracking section comprises at least one hydrocracking reactor of the hybrid type.

These variations of the invention include in particular for the hydrocracking section, instead of the two hybrid-bed reactors (98) and (102):

- a hydrocracking reactor of the ebullating bed type followed by a hydrocracking reactor of the hybrid-bed type
- a hydrocracking reactor of the hybrid-bed type followed by a hydrocracking reactor of the hybrid-bed type
- a hydrocracking reactor of the hybrid-bed type alone.

In the variants relating to the type of hydrocracking reactors described above, it is also possible to intercalate an inter-stage separator allowing the removal of at least one gas fraction between two hydrocracking reactors.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 1460629, filed Nov. 4, 2014, is incorporated by reference herein.

Comparative Example According to the Prior Art and According to the Invention The following example illustrates the invention without however limiting its scope.

A vacuum residue (Ural VR) containing 87.0% by weight of compounds boiling at a temperature greater than 520° C., having a density of 9.5° API and a sulphur content of 2.72% by weight was treated.

The feedstock was subjected to a fixed-bed hydrotreatment stage a) including two switchable reactors. The operating conditions are given in Table 1.

TABLE 1

Operating conditions of fixed-bed hydrotreatment stage a)

| HDM and HDS catalysts | NiCoMo on alumina |
|---|---|
| Temperature (° C.) | 370 |
| Partial pressure H2 (MPa) | 15 |
| LHSV (h-1, Sm3/h fresh feedstock/m3 of fixed-bed catalyst) | 0.18 |
| H2/HC inlet to fixed bed section excluding H2 consumption (Nm3/m3 of fresh feedstock) | 1000 |

The effluent from the hydrotreatment is then subjected to a separation stage b) as described in FIG. 1 making it possible to recover a gas fraction and a heavy fraction containing a majority of compounds boiling at more than 350° C. (350° C.+ fraction).

The heavy fraction (350° C.+ fraction) is then treated according to two procedures:

a) in a hydrocracking stage c) comprising two successive ebullating-bed reactors (not according to the invention, according to the prior art).

b) in a hydrocracking stage c) comprising two successive ebullating-bed reactors with addition of a dispersed catalyst operating according to a "hybrid" mode (according the invention).

The operating conditions of hydrocracking stage c) are given in Table 2.

TABLE 2

Operating conditions of hydrocracking section c) in the two procedures: (a) two ebullating beds, (b) two hybrid ebullating beds

| | (Not according to the invention) 2 ebullating beds | (According to the invention) 2 hybrid ebullating beds |
|---|---|---|
| Catalysts | NiMo on alumina | NiMo on alumina + Mo Naphthenate |
| R1 temperature (° C.) | 423 | 423 |
| R2 temperature (° C.) | 431 | 431 |
| Partial pressure of H2 (MPa) | 13.5 | 13.5 |
| LHSV of "reactors" (h-1, Sm3/h fresh feedstock/m3 of reactors) | 0.3 | 0.3 |
| LHSV of "ebullating-bed catalysts" (h-1, Sm3/h fresh feedstock/m3 of ebullating-bed catalysts) | 0.6 | 0.6 |
| Concentration of "dispersed" catalyst (ppm of precursor in the feedstock at inlet to "hybrid" beds) | — | 100 |
| H2/HC inlet to hydrocracking section excluding H2 consumption (Nm3/m3 of fresh feedstock) | 600 | 600 |

The effluents from the hydrocracking stage were then subjected to a separation stage d) making it possible to separate the gases and the liquids by means of separators and atmospheric and vacuum distillation columns.

Furthermore, prior to the vacuum distillation stage, the atmospheric residue fraction undergoes a treatment according to 2 variants:

- a stage of separation of the sediments and residues of catalysts comprising a Pall® porous metal filter (not according to the invention, according to the prior art)
- a stage of treatment of sediments and residues of catalysts comprising a maturation stage (4 h at 150° C. carried out in a heated stirred tank in the presence of an air/nitrogen mixture 50/50 under a total pressure of 0.5 MPa) and physical separation of the sediments and residues of catalysts comprising a filter (according to the invention)

The yields and the sulphur contents of each fraction obtained in the effluents leaving the overall sequences are given in Table 3 below:

TABLE 3

Yields and sulphur content of the effluent from the hydrocracking section (% by weight/feedstock)

| | (Not according to the invention) a)Hydrotreatment in fixed bed + b)separation + c)Hydrocracking in 2 ebullating beds (423/431° C.) | | (According to the invention) a)Hydrotreatment in fixed bed + b)separation + c)Hydrocracking in 2 hybrid ebullating beds (423/431° C.) | |
|---|---|---|---|---|
| Products | Yield (by weight) | S (by weight) | Yield (by weight) | S (by weight) |
| NH3 | 0.7 | 0 | 0.7 | 0 |
| H2S | 2.7 | 94.12 | 2.7 | 94.12 |
| C1-C4 (gas) | 4.0 | 0 | 4.1 | 0 |
| Naphtha (IP-150° C.) | 9.3 | 0.02 | 9.9 | 0.02 |
| Diesel (150° C.-350° C.) | 24.6 | 0.05 | 25.5 | 0.05 |
| Vacuum distillate (350° C.-520° C.) | 31.5 | 0.28 | 32.4 | 0.29 |
| Vacuum residue (520° C.+) | 29.3 | 0.47 | 26.7 | 0.49 |

It is possible to calculate the conversion rate (difference between the quantity of components boiling above 520° C. in the feedstock and that in the effluent, divided by that of feedstock) and the hydrodesulphurization rate (difference between the quantity of sulphur in the feedstock and that in the effluent liquid, divided by that of feedstock).

Finally, the operating conditions of the hydrocracking stage coupled with the different variants of treatment (separation of the sediments with or without treatment) of the heavy phase originating from the atmospheric distillation have an impact on the stability of the effluents obtained.

This is illustrated by the sediment contents after ageing measured in the atmospheric residues (350° C.+ cut) after separation or after the sediment treatment stage.

The performances of the three treatment systems are summarized in Table 4 below:

TABLE 4

Summary of performances in the processes according to the prior art and according to the invention

| | (Not according to the invention) Hydrotreatment in fixed bed + separation + Hydrocracking in 2 ebullating beds (423/431° C.) | (According to the invention) Hydrotreatment in fixed bed + separation + Hydrocracking 2 hybrid ebullating beds (423/431° C.) | |
|---|---|---|---|
| H2 consumption by weight/feedstock) | 1.8 | 2.0 | |
| Hydrodesulphurization rate (%) | 91 | 91 | |
| Conversion rate (%) | 66 | 69 | |
| Treatment | No | No | Yes |
| Separation of the sediments | Yes | Yes | Yes |

TABLE 4-continued

Summary of performances in the processes according to the prior art and according to the invention

| | (Not according to the invention) Hydrotreatment in fixed bed + separation + Hydrocracking in 2 ebullating beds (423/431° C.) | (According to the invention) Hydrotreatment in fixed bed + separation + Hydrocracking 2 hybrid ebullating beds (423/431° C.) | |
|---|---|---|---|
| Sediment content after ageing (IP390) in the 350° C.+ cut originating from the separation of the sediments | 0.4 | 0.5 | <0.1 |

The results show the significant gain obtained in terms of conversion in the case of the two procedures according to the invention (2 hybrid ebullating beds). These particularly high conversion rates illustrate the production of conversion products (mainly distillates) in a significant quantity.

The sediment treatment stage e) implementing maturation prior to the physical separation of the sediments proves indispensable for forming the mixture of the potential sediments and thus allow their effective separation. Without the treatment, beyond a certain level of conversion which leads to many potential sediments being obtained, the sediment separation stage is not sufficiently effective for the sediment content after ageing (IP390) to be less than 0.1% by weight, i.e. the maximum content required for the bunker oils of residual type.

On the other hand, in the case of lower grade applications (fuel oil for producing refinery utilities for example), the sediment treatment stage e) can be optional, the sediment content will then be greater than 0.1% by weight.

Subsequently, a mixture is prepared from 350° C.-520° C. and 520° C.+ cuts originating from the sequence a) fixed-bed hydrotreatment+b) separation+c) hydrocracking with 2 hybrid ebullating beds+d) separation of the effluent+e) treatment of the sediments, in the following proportions:

150° C.-350° C. cut: 2% by weight of the mixture, and

350° C.-520° C. cut: 41% by weight of the mixture, and

520° C.+ cut: 57% by weight of the mixture.

A fuel oil is thus obtained, having a sulphur content of 0.40% by weight, and having a viscosity of 375 cSt at 50° C. Furthermore, its sediment content after ageing is less than 0.1% by weight. In view of these analyses, this fuel oil is particularly suitable for constituting a bunker oil of residual type similar to the grade RMG 380 as recommended by the IMO outside the SECAs for the 2020-2025 time frame.

In addition to the first mixture leading to a fuel oil with 0.40% sulphur, a second mixture was produced, comprising 85% by weight of a fraction originating from the diesel cut and 15% by weight of a fraction originating from the vacuum distillate cut. In these proportions, the mixture has a sulphur content of 0.08% and a viscosity of 6 cSt at 40° C. This mixture thus constitutes a marine fuel of the distillate type ("marine gas-oil" or "marine diesel") which may be similar to the grade DMB (the viscosity specification of which is comprised between 2 cSt and 11 cSt at 40° C.) for example.

Because of its sulphur content of less than 0.1%, this mixture constitutes a fuel of choice for the SECAs for 2015 time frame.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for treatment of a heavy hydrocarbon-containing feedstock having a sulphur content of at least 0.5% by weight, an initial boiling temperature of at least 350° C. and a final boiling temperature of at least 450° C., to obtain at least one liquid hydrocarbon-containing fraction having a sulphur content less than or equal to 0.5% by weight, said liquid hydrocarbon-containing fraction being a fuel of the heavy fuel type that can optionally become a marine fuel, said process comprising the following successive stages:

a) a fixed-bed hydrotreatment stage wherein said hydrocarbon-containing feedstock and hydrogen are brought into contact with a hydrotreatment catalyst, b) a separation stage wherein effluent obtained from said hydrotreatment stage (a) is separated into at least one first light fraction and at least one first heavy fraction, c) a hydrocracking stage wherein at least a part of said at least one first heavy fraction obtained from separation stage (b), alone or in a mixture with other residual or fluxing cuts, is subjected to hydrocracking in at least one reactor operating as an ebullating bed with a supported catalyst combined with a dispersed catalyst constituted by very fine particles of catalyst present as a suspension with said at least a part of said at least one first heavy fraction which is to be treated in said hydrocracking stage, wherein said supported catalyst is in the form of extrudates having a diameter between 0.8 and 1.2 mm and the particles of said dispersed catalyst have a size between 10 and 150 microns, d) a further separation stage for separating effluent originating from hydrocracking stage (c) wherein said effluent originating from hydrocracking stage (c) is separated to obtain at least one second light fraction and at least one second heavy fraction, e) a sediment treatment stage for reducing the sediment content of the at least one second heavy fraction originating from the further separation stage d), wherein said sediment treatment stage comprises (i) a maturation stage wherein potential sediments are converted to existing sediments, and (ii) subsequent steps of solid-liquid separation for removal of the existing sediments and catalyst residues, and recovery of dispersed catalyst, wherein the steps of the solid-liquid separation for removal of the existing sediments and catalyst residues, and the recovery of dispersed catalyst are carried out simultaneously, f) a final separation stage for separating the second heavy fraction effluent from sediment treatment stage e) in order to obtain said at least one liquid hydrocarbon-containing fraction having a sulphur content less than or equal to 0.5% by weight wherein said at least one liquid hydrocarbon-containing fraction has a sediment content of less than 0.1% by weight.

2. The process according to claim 1, wherein said hydrocracking stage is operated under the following operating conditions:

a partial pressure of hydrogen varying from 2 to 35 MPa, a temperature between 330° C. and 550° C., an hourly space velocity between 0.1 and $10^{-1}$, an ebullating-bed catalyst hourly space velocity between 0.1 and $5^{-1}$ for said at least one reactor operating as an ebullating-bed between 0.1 and $5^{-1}$, wherein said ebullating-bed catalyst hourly space velocity is defined as the ratio between the volume flow rate of feedstock in $m^3/h$ and the volume in $m^3$ of inactive ebullating-bed catalyst and the expansion rate of the ebullating bed is zero, a metal compounds content in the catalysts used in said at least one reactor operating as an ebullating-bed of between 0 and 10% by weight, wherein said metal compounds content is expressed as a percentage by weight of metallic elements of group VIII and/or of group VIB, and a hydrogen/feedstock ratio of between 50 and 5000 $Nm^3/m^3$.

3. The process according to claim 1, wherein said hydrocracking stage comprises two reactors, one reactor operating as an ebullating bed, the other reactor operating said reactor operating as an ebullating bed with a supported catalyst combined with a dispersed catalyst.

4. The process according to claim 1, wherein said hydrocracking stage comprises two reactors, wherein both reactors operating as an ebullating bed with a supported catalyst combined with a dispersed catalyst.

5. The process according to claim 1, wherein said hydrocracking stage comprises a single reactor operating as said ebullating bed with a supported catalyst combined with a dispersed catalyst.

6. The process according to claim 1, wherein particles of said dispersed catalyst have a size between 10 and 80 microns.

7. The process according to claim 1, wherein said further separation stage d) is a flash separation.

8. The process according to claim 2, wherein said hydrocracking stage is operated under the following operating conditions:

a partial pressure of hydrogen varying from 10 to 25 MPa, a temperature between 350° C. to 500° C., an hourly space velocity between 0.1 and $5^{-1}$, an ebullating-bed catalyst hourly space velocity between 0.1 and $3^{-1}$ for said at least one reactor operating as an ebullating-bed with a supported catalyst combined with a dispersed catalyst, a metal compounds content in the catalysts used in said at least one reactor operating as an ebullating-bed of between 0 and 1% by weight, and a hydrogen/feedstock ratio of between 100 and 1500 $Nm^3/m^3$.

9. The according to claim 2, wherein said hydrocracking stage is operated at a temperature between 370° C. and 480° C.

10. The according to claim 2, wherein said hydrocracking stage is operated at an hourly space velocity between 0.1 and $2^{-1}$.

11. The according to claim 2, wherein said at least one reactor operating as an ebullating-bed of said hydrocracking stage is operated at an ebullating-bed catalyst hourly space velocity between 0.1 and $1^{-1}$.

12. The according to claim 2, wherein said hydrocracking stage is operated at a hydrogen/feedstock ratio of comprised between 500 and 1300 $Nm^3/m^3$.

13. The according to claim 1, wherein said fixed-bed hydrotreatment stage (a) comprises:

a first hydrodemetallization stage (a1) wherein said hydrocarbon-containing feedstock and hydrogen are brought into contact with hydrodemetallization catalyst and hydrodemetallization is performed, said first hydrodemetallization stage comprising one or more hydrodemetallization zones containing fixed beds, and a second hydrodesulphurization stage (a2) wherein effluent from said first hydrodemetallization stage (a1) is brought into contact with a hydrodesulphurization catalyst and hydrodesulphurization is performed, said second hydrodesulphurization stage comprising one or more hydrodesulphurization zones containing fixed beds.

14. The according to claim 1, wherein effluent from the hydrotreatment stage (a) undergoes separation, with decompression, in separation stage (b), and in separation stage (b) separation is carried out in: a fractionation section comprising a high pressure high temperature separator and a high pressure low temperature separator, followed by an atmospheric distillation section and/or by a vacuum distillation section.

15. The according to claim 1, wherein effluent from the hydrotreatment stage (a) undergoes separation, without decompression, in separation stage (b), wherein effluent from the hydrotreatment stage (a) is separated in a separation section comprising high pressure high temperature separator, to obtain at least one light fraction and at least one heavy fraction, and said at least one heavy fraction is directly sent, in mixture with a hydrogen-rich gas, into said hydrocracking stage (c), and said at least one light fraction is cooled and then introduced into a high pressure low temperature separator in which a gas fraction containing hydrogen and a liquid fraction containing distillates are separated, and said liquid fraction containing distillates can be sent to said hydrocracking stage c).

16. The process according to claim 1, wherein said further separation stage d) for separating effluent originating from hydrocracking stage (c) comprises a high pressure high temperature (HPHT) separator and/or a high pressure low temperature (HPLT) separator, and an atmospheric distillation and/or a vacuum distillation.

17. The process according to claim 1, wherein in said maturation stage of said sediment treatment stage e) said at least one second heavy fraction originating from the further separation stage d) is heated to a temperature between 200 and 300° C. at a pressure of less than 30 bar, and is held in said maturation stage for a residence time between 60 and 180 minutes.

18. The process according to claim 1, wherein in said maturation stage of said sediment treatment stage e) said at least one second heavy fraction originating from the further separation stage d) is heated to a temperature between 100 and 500° C. at a pressure of less than 200 bar, and is held in said maturation stage for a residence time between 1 and 1500 minutes.

19. The process according to claim 1, wherein in said maturation stage of said sediment treatment stage e) said at least one second heavy fraction originating from the further separation stage d) is heated to a temperature between 100 and 500° C. at a pressure of less than 100 bar, and is held in said maturation stage for a residence time between 1 and 1500 minutes.

20. The process according to claim 1, wherein in said maturation stage of said sediment treatment stage e) said at least one second heavy fraction originating from the further separation stage d) is heated to a temperature between 200 and 300° C. at a pressure of less than 15 bar, and is held in said maturation stage for a residence time between 60 and 180 minutes.

21. A process for treatment of a heavy hydrocarbon-containing feedstock having a sulphur content of at least 0.5% by weight, an initial boiling temperature of at least 350° C. and a final boiling temperature of at least 450° C., to obtain at least one liquid hydrocarbon-containing fraction having a sulphur content less than or equal to 0.5% by weight, said liquid hydrocarbon-containing fraction being a fuel of the heavy fuel type that can optionally become a marine fuel, said process comprising the following successive stages:

a) a fixed-bed hydrotreatment stage wherein said hydrocarbon-containing feedstock and hydrogen are brought into contact with a hydrotreatment catalyst, b) a separation stage wherein effluent obtained from said hydrotreatment stage (a) is separated into at least one first light fraction and at least one first heavy fraction, c) a hydrocracking stage wherein at least a part of said at least one first heavy fraction obtained from separation stage (b), alone or in a mixture with other residual or fluxing cuts, is subjected to hydrocracking in at least one reactor operating as an ebullating bed with a supported catalyst combined with a dispersed catalyst constituted by very fine particles of catalyst present as a suspension with said at least a part of said at least one first heavy fraction which is to be treated in said hydrocracking stage, wherein said supported catalyst is in the form of extrudates having a diameter between 0.8 and 1.2 mm and the particles of said dispersed catalyst have a size between 10 and 150 microns, d) a further separation stage for separating effluent originating from hydrocracking stage (c) wherein said effluent originating from hydrocracking stage (c) is separated to obtain at least one second light fraction and at least one second heavy fraction, e) a sediment treatment stage for reducing the sediment content of the at least one second heavy fraction originating from the further separation stage d), wherein said sediment treatment stage comprises (i) a maturation stage wherein potential sediments are converted to existing sediments, and (ii) a subsequent solid-liquid separation for removal of the existing sediments and catalyst residues, and f) a final separation stage for separating the second heavy fraction effluent from sediment treatment stage e) in order to obtain said at least one liquid hydrocarbon-containing fraction having a sulphur content less than or equal to 0.5% by weight wherein said at least one liquid hydrocarbon-containing fraction has a sediment content of less than 0.1% by weight.

* * * * *